US009308562B2

(12) United States Patent
Diehl et al.

(10) Patent No.: US 9,308,562 B2
(45) Date of Patent: Apr. 12, 2016

(54) ROLL STAND

(75) Inventors: Christian Diehl, Hilchenbach (DE); Achim Klein, Kreuztal (DE); Bernd Zieser, Netphen (DE); Florian Lindner, Netphen (DE)

(73) Assignee: SMS group GmbH, Duesseldorf (DE)

( * ) Notice: Subject to any disclaimer, the term of this patent is extended or adjusted under 35 U.S.C. 154(b) by 1061 days.

(21) Appl. No.: 13/057,200

(22) PCT Filed: Sep. 22, 2009

(86) PCT No.: PCT/EP2009/006878

§ 371 (c)(1),
(2), (4) Date: Jun. 22, 2011

(87) PCT Pub. No.: WO2010/034481

PCT Pub. Date: Apr. 1, 2010

(65) Prior Publication Data

US 2011/0239723 A1 Oct. 6, 2011

(30) Foreign Application Priority Data

Sep. 26, 2008 (DE) ..... 10 2008 049 179

(51) Int. Cl.

| | |
|---|---|
| ***B21B 31/32*** | (2006.01) |
| ***B21B 29/00*** | (2006.01) |
| *B21B 31/18* | (2006.01) |
| *B21B 31/20* | (2006.01) |
| *B21B 13/02* | (2006.01) |

(52) U.S. Cl.

CPC ..... *B21B 31/32* (2013.01); *B21B 29/00* (2013.01); *B21B 31/18* (2013.01); *B21B 31/203* (2013.01); *B21B 2013/025* (2013.01); *B21B 2013/028* (2013.01)

(58) Field of Classification Search

CPC ..... B21B 13/14; B21B 13/142; B21B 31/32; B21B 29/00; B21B 31/203; B21B 2013/028; B21B 2013/025; B21B 31/18

USPC ..... 72/237, 241.4, 241.8, 247, 241, 241.2

See application file for complete search history.

(56) References Cited

U.S. PATENT DOCUMENTS

| | | | | |
|---|---|---|---|---|
| 4,736,609 | A * | 4/1988 | Schiller et al. | 72/244 |
| 4,934,166 | A | 6/1990 | Giacomoni | |
| 4,967,582 | A | 11/1990 | Bohnenkamp | |
| 5,666,845 | A * | 9/1997 | Thomas | 72/238 |
| 5,806,360 | A * | 9/1998 | Dumas | 72/241.8 |
| 5,921,129 | A * | 7/1999 | Drigani et al. | 72/237 |
| 6,112,569 | A * | 9/2000 | Ossendorf | 72/241.8 |
| 6,519,994 | B1 * | 2/2003 | Quambusch | 72/237 |

(Continued)

FOREIGN PATENT DOCUMENTS

JP 53141150 A 12/1978

*Primary Examiner* — David Bryant
*Assistant Examiner* — Lawrence Averick
(74) *Attorney, Agent, or Firm* — Andrew Wilford

(57) ABSTRACT

A roll stand (1) with at least one upper and one lower roll (2, 3) supported by respective backing rolls (4, 5) mounted on a common roll frame (8) and in bearings that are vertically displaceable with respect to each other for setting different roll gaps, with at least one axial shifter for one of rolls (2, 3) and with at least one bender comprising a bending cylinder (16) for bending the upper roll (3) is characterized in that the bender comprises horizontal traverses (12) and bending arms (13) at each ends of the upper roll (3), whereby for setting the roll gap height between rolls (2, 3) the roll (3) is guided by bending arms (13).

11 Claims, 4 Drawing Sheets

(56) References Cited

U.S. PATENT DOCUMENTS

| | | | | |
|---|---|---|---|---|
| 7,310,985 | B2 | 12/2007 | Thiel | |
| 7,665,339 | B2 | 2/2010 | Valence et al. | |
| 7,895,871 | B2 * | 3/2011 | Zieser et al. | 72/245 |
| 2005/0066698 | A1 * | 3/2005 | Tauber et al. | 72/10.7 |
| 2007/0129228 | A1 * | 6/2007 | Zieser et al. | 492/15 |

* cited by examiner

B-B

C-C

ROLL STAND

CROSS REFERENCE TO RELATED APPLICATIONS

This application is the US national phase of PCT application PCT/EP2009/006878, filed 22 Sep. 2009, published 1 Apr. 2010 as WO2010/034481, and claiming the priority of German patent application 102008049179.9 itself filed 26 Sep. 2008.

FIELD OF THE INVENTION

The invention concerns a roll stand with at least one upper and one lower roll supported by respective backing rolls mounted on a common roll frame and in bearings that are vertically displaceable with respect to each other for setting different roll gaps, with at least one axial shifter for one of the rolls and with at least one bender comprising a bending cylinder for bending the upper roll.

BACKGROUND OF THE INVENTION

Roll stands of this type can have especially several backing rolls above and below the roll gap, for instance, one work roll that comes in direct contact with the rolling stock and in turn rolls on a usually larger backing roll or an intermediate roll, which in turn abuts another backing roll. The work rolls and/or the backing rolls and/or the intermediate rolls can be displaceable axially relative to each other. This way as a result of the shape of the surface of at least two rolls, targeted effects are possible with respect to the shape of the rolling stock running through the roll gap. The height of the roll gap is thereby intended to be adjustable, which requires a vertical displacement at the frame.

It is particularly difficult when in addition to the axial shifter, a work-roll bender is provided, even for a large roll intake, i.e. at large height of the roll gap, to guarantee the ability to set it. This is because in the bender, which is intended to counter-act a bending apart of the rolls that define the gap for the rolling stock, integrated locking elements as well as the guide elements for the axial shifter and the bearings for the rolls in the lateral beams of the frame, must be displaced and selected.

A roll stand is known from EP 1 436 104 [U.S. Pat. No. 7,310,985] with at least one axial shifter that makes it possible to set a large roll gap for rolling of thick blocks or slabs. In the known solution, the axial shifter is integrated into the construction components that retain the bearings for a work roll, so that a separate vertical displaceability of the axial shifter is no longer required.

The axial displacement of the work rolls is done by a shifter mounted coaxially on an insert of the work roll that is backed out of the frame with the set of rolls during a change of the work roll. In so-called "flying" work-roll bending, the upper work-roll inserts are supported by bending or balancing cylinders in U-shaped recesses of the upper backing-roll inserts. The bending cylinders can be located in the work-roll inserts or alternatively in the backing-roll inserts.

With a "flying" arrangement of the upper work roll, a very tall roll gap is conceivable. This would also make the rolling of thick blocks possible on such a roll stand. The work roll displacement and benders are backed out of the roll frame during a change of the set of rolls and can be maintained outside the roll frame. As a result, the operator does not have down time of the system while maintaining these units.

During axial displacement of the work roll, the upper work-roll assembly is pushed via the bending cylinders that serve to balance pressure into the upper backing-roll inserts. The frictional forces thus created generate moments of tilt that can bring about a skewing of the backing-roll inserts. In a sudden loading of the stand with roll force, the so-called tapping push, subsequent to the displacement of the work roll it can therefore not be precluded that at the backing roll bearing—in the case of flooded oil bearings—there is a high load between the bearing bushing and the stub or in the event of ball bearings, individual bearing rows experience high strain.

With the known work roll shifters and benders that avoid the disadvantage mentioned above, however, a roll rise, i.e. a roll gap for the throughput of rolling stock, can be set of only up to approximately 550 mm.

OBJECT OF THE INVENTION

It is the object of the invention to create a roll stand with a work-roll axial shifter and bender that can also set a very tall roll gap.

SUMMARY OF THE INVENTION

In a roll stand of the type mentioned above, this problem is solved in that the benders at the two ends of the roll each have a horizontal traverse and a bending arm, so that the roll for setting the roll gap height between the rolls is guided by the bending arms. This way the roll-gap shape can be influenced by axial displacement of the roll even with thick-plate frames with typical gap heights of approximately 1,100 mm.

It is advantageously provided that the bending arms are mounted in recesses of the roll frame or the roll stand. Likewise, the bending arms are guided in respective guide bars bolted to the roll fame.

Preferably, the bending arms are guided in or engage around the middle of the roll frames or roll frame beams.

It is also advantageous when the upper backing roll is journaled at its ends in respective backing-roll inserts. A further step in accordance with the invention is that the bending cylinders are mounted vertically to the balancing arms with respect to the upper backing roll.

In a further development of the invention, the bending cylinders act upon the horizontal traverses that are guided on the balancing arms of the upper backing roll as well as on the guide bars. Advantageously, the bending arms can be detachably connected with the horizontal traverses or balancing arms, for example, hung on them.

In an advantageous embodiment of the invention the work rolls are mounted in respective work-roll inserts and the upper work-roll inserts are each acted on by a force from the bending arms. The bending cylinders of the upper work roll can be mounted on lower thickened regions of the bending arms.

Moreover, the bending or balancing cylinders of the inserts of the lower work roll are mounted vertically in stationary blocks.

The axial shifters are preferably designed as hydraulic piston and cylinder units. The actuator of the axial shifter is designed preferably in the form of a piston, that is mounted with one of its axial ends in a bracket that is fixed in a guide displaceable in a straight line particularly in a sliding guide.

BRIEF DESCRIPTION OF THE DRAWING

In the following, the invention is explained in more detail in an example of an embodiment. Therein.

SPECIFIC DESCRIPTION OF THE INVENTION

A roll stand indicated overall at 1 (FIG. 1, 2) is designed as a so-called four-roll frame and comprises two work rolls 2, 3 and two backing rolls 4, 5. A different number of rolls is also possible, for example, a design of a six roll frame with additional intermediate rolls between the work rolls 2, 3 and the backing rolls 4, 5. Between the work rolls 2, 3 and the backing rolls 4, 5, there is a roll gap 6 for the rolling stock to be rolled. A height 7 of the roll gap 6, the so-called gap height can be set.

Figure 1:
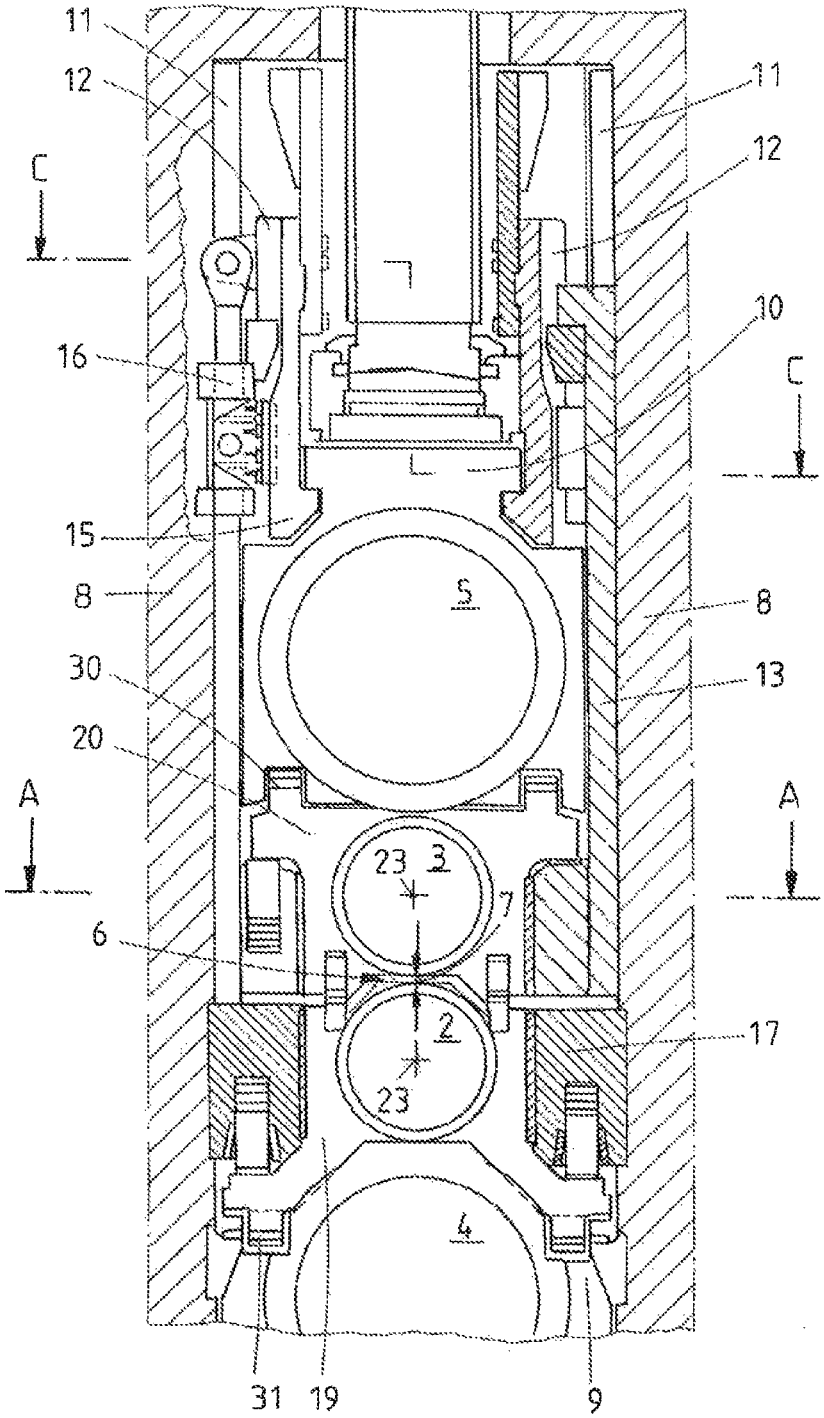
FIG. 1 is a section through a roll stand with one work-roll pair and one backing-roll pair.
Figure 2:
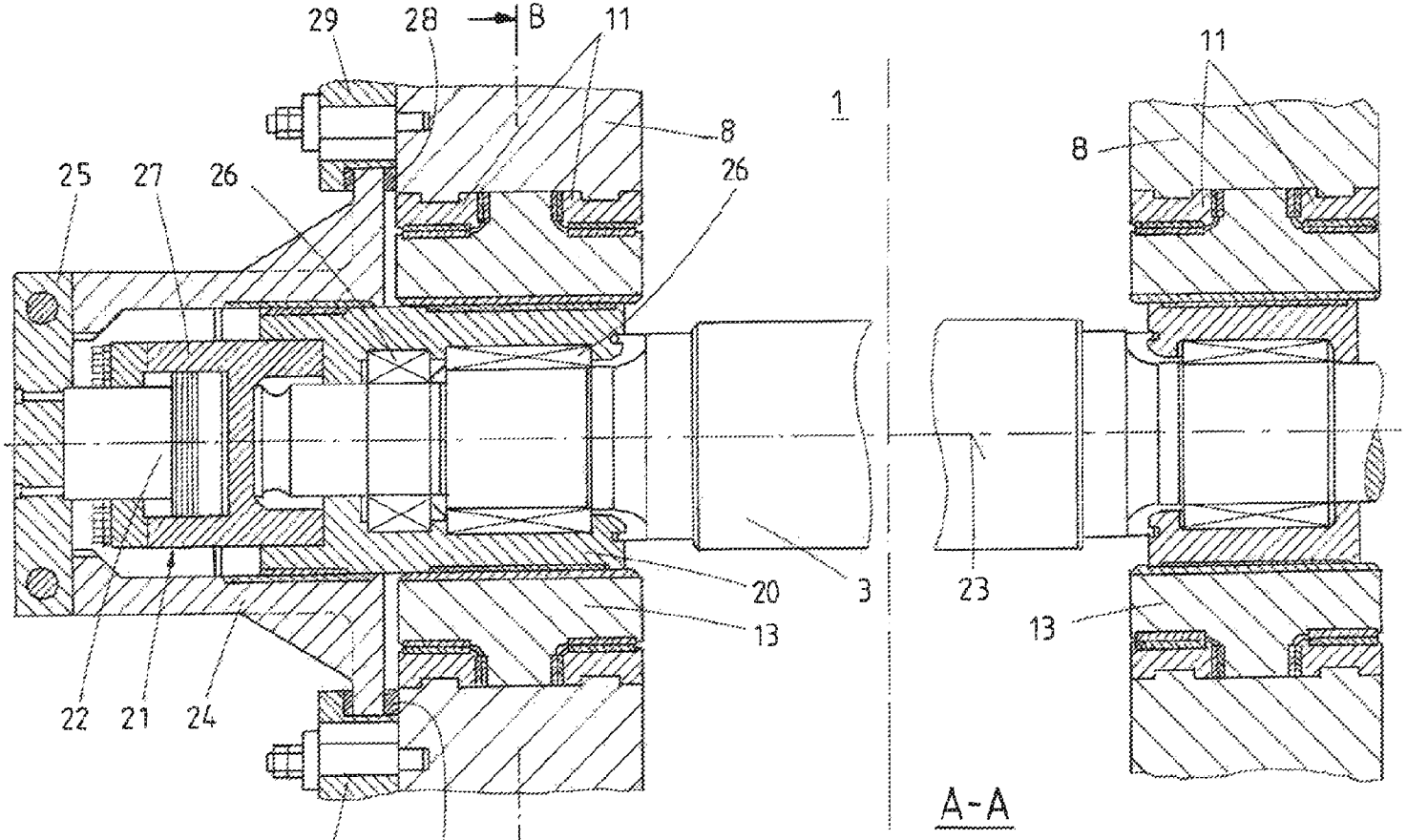
FIG. 2 is a section through the upper work roll from FIG. 1 taken on section plane A-A.

The rolls 2, 3, 4, 5 are carried in a roll frame 8 (FIG. 1, 2, 4). The roll frame 8 has backing-roll inserts 9, 10 that carry the lower and the upper backing rolls 4, 5.

Figure 3:
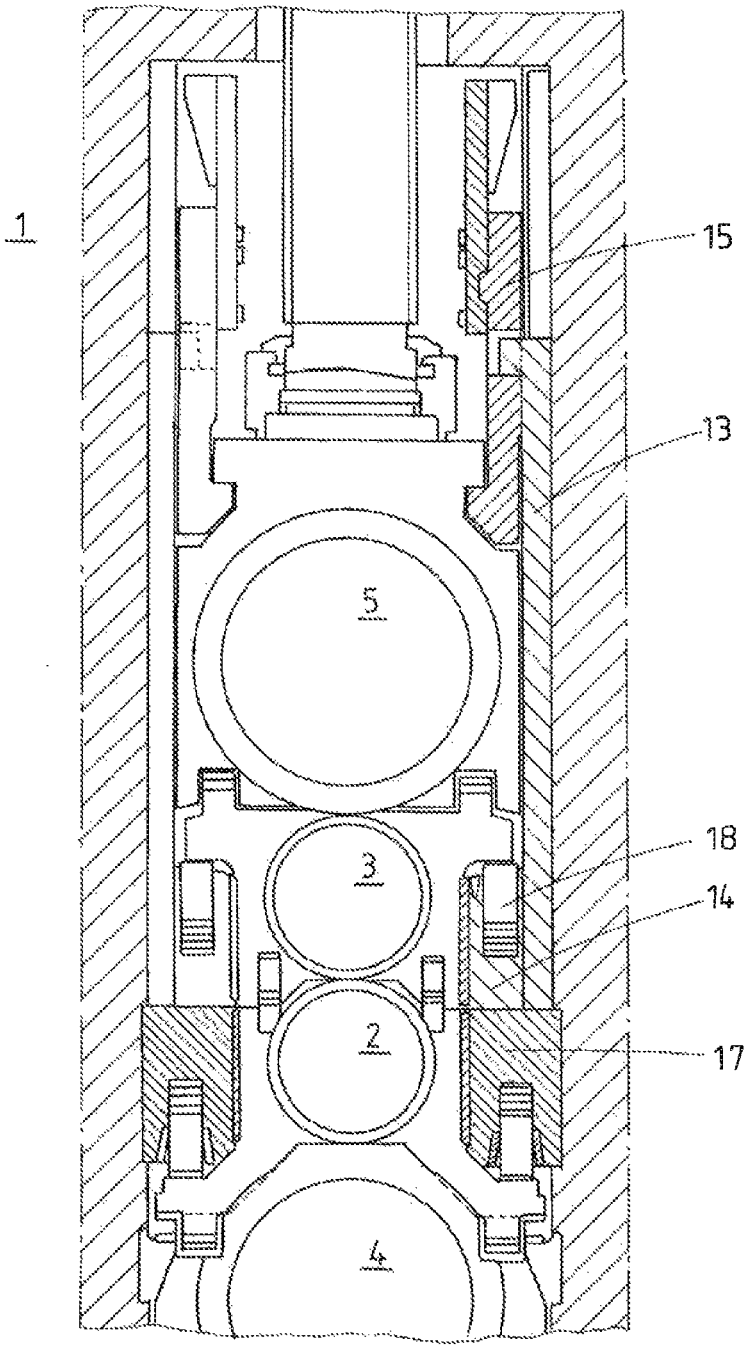
FIG. 3 is a section through a roll stand taken on section plane B-B of FIG. 2.
Figure 4:
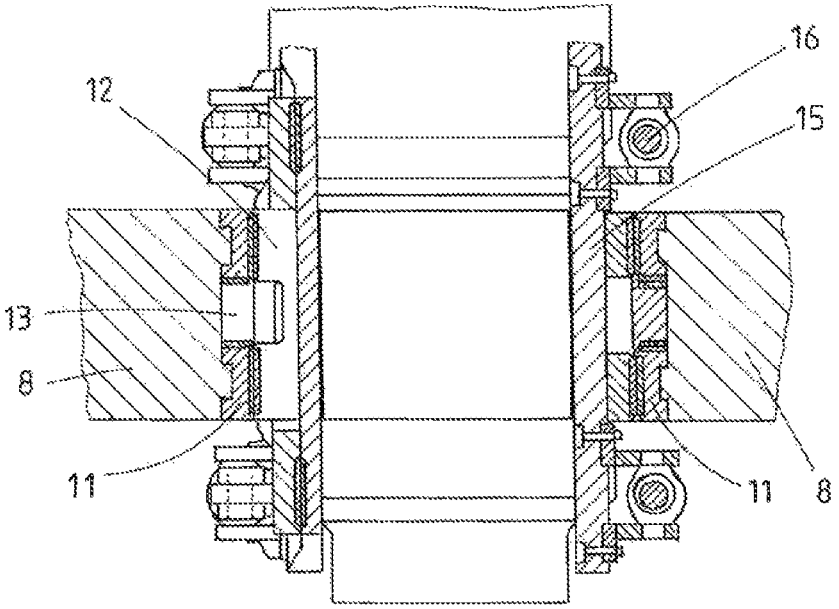
FIG. 4 is another section taken on a line C-C of FIG. 1.

Horizontal traverses 12 can move along guide bars 11 that are also carried in the roll frame 8. Bending arms 13 move the upper work-roll assembly when the height of the roll gap 6 is set. At their lower ends, the bending arms 13 have thickened regions 14 (FIG. 3). The horizontal traverses 12 are guided on balancing arms 15; bending cylinders 16 act upon them to bend the upper work roll 3. Similarly, the lower work roll 2 is bent by a bending cylinder 17. An alternative bending means for bending the upper work roll 3 is labeled 18.

The bending cylinders 16, 17, as well as alternate 18 act upon the outer ends of the work rolls 2, 3, and thus exert a force that is directed vertically outward from the roll gap 6 on the ends of the rolls 2, 3, corresponding to the force of the rolling stock that is in effect in the middle section, in order to counteract a spreading of the work rolls 2, 3 by the rolling stock.

In addition to the so-called positive bending of the work rolls via bending means 16, 17, as well as alternate 18, for increasing the setting range for influencing the profile, a so-called negative work-roll bending can also be effected by additional piston-cylinder systems 30, 31 (see FIG. 1).

The backing-roll inserts 9, 10 vertically flank work-roll inserts 19, 20 in which the work rolls 2, 3 are journaled via bearings 26.

Axial shifters 21 are provided at the outer ends of the work rolls 2, 3.

A piston 22 of each axial shifter 21 is carried by an abutment 25 on holder arms 24 that can slide horizontally in work-roll inserts 19, 20. The holder arms 24 are held by lateral brackets 29 that are fixed via bearings 28 on the outside of the roll frame 8 and prevent horizontal movement of the holder arms 24 parallel to a roll axis 23. As a result, the piston 22 is also fixed axially in a cylinder 27 of the axial shifter 21. The holder arms 24 are displaceable vertically in the lateral brackets 29.

The invention thus relates to a system that allows bending as well as displacement of the work rolls 2, 3. The bending or balancing cylinders 17 that are mounted vertical in stationary blocks are dedicated to the lower work roll 2. The bender of the upper work roll 3 is identified by two novel components: the horizontal traverse 12 and the bending arm 13.

When setting the height of the roll gap 6, the movement of the upper work-roll assembly is done by the bending arms 13. The bending arms 13 in turn are guided in bars that are bolted to the roll stand 8, or alternatively sent directly in recesses in the roll frame 8. This way the bending arms 13 can be guided in the middle section of the roll frame beams or alternatively, engage around the roll frame beams.

The bending or balancing cylinders 16 of the upper work roll are mounted vertically on the arms 15 of the upper backing roll 5 and move during positioning of the upper rolls 3, 5 with the balancing arms 15 and thereby need a comparable small travel, which is determined by the roll stock wear of the upper rolls 3, 5.

The bending or balancing cylinders act on the horizontal traverses 12 that are guided in the balancing arms 15 relative to the upper backing rolls 5, as well as on the guide bars 11. The bending arms 13, which are suspended on the horizontal traverses 12, exert a vertical force on the inserts relative to the upper work roll 3.

In an alternative embodiment for bending the upper work roll, the bending arms 13 are hung directly on the balancing arms 15. The bending or balancing cylinders are thus positioned relative to the upper work roll 3 in the lower thickened regions of the bending arms 13.

The bending arms 13 that ensure good guidance of the upper work roll inserts even for a tall roll gap, simultaneously absorb those frictional forces that would otherwise skew the backing-roll inserts 9, 10 during axial displacement of the rolls.

The axial shifters of the work rolls 2, 3 are the hydraulically actuated piston-cylinder systems 21 located at the work-roll inserts 19, 20 on the side of the operator. Here the piston of the cylinder unit is connected with the holder arms guided in the respective insert. Interlocks that are located at the outer side of the two beams of the roll frame stand on the side of the operator prevent horizontal displacement of the holder arms during rolling operation and thus an axial displacement of the cylinder piston. As a result of the application of pressure on the piston side or on the pin side of the piston-cylinder unit, an axial displacement of the work rolls 2, 3 mounted in the inserts 19, 20 is realized.

The invention claimed is:

1. A roll stand comprising:

a common roll frame;

at least one upper and one lower work roll each having two opposite ends;

respective backing rolls supporting the upper and lower work rolls on the common roll frame;

inserts rotatably supporting the backing rolls in the frame and vertically displaceable toward each other for setting different roll gap heights;

at least one axial shifter for one of work rolls; and respective benders at ends of the work rolls and each having vertical guide bars fixed on the frame, a horizontal traverse movable vertically along the guide bars, the upper rolls being suspended from and vertically movable with the horizontal traverses, a horizontal balancing arm carried by the traverse and connected to the upper backing roll, a respective bending arm carried by the vertically movable on the guide bars at each end of the upper work roll, and a bending cylinders carried on the bending arms and on the horizontal traverses and bearing on the upper work roll for vertically bending the upper work roll and on the upper backing roll for setting the roll gap.

2. The roll stand defined in claim 1, wherein the bending arms are set in recesses of the roll frame or the roll stand.

3. The roll stand defined in claim 2, wherein the bending arms are guided in or engage around the middle section of the roll frame.

4. The roll stand defined in claim 1, wherein the upper backing roll is held at its ends in respective backing-roll inserts.

5. The roll stand defined in claim 1, wherein the bending cylinders are vertical to balancing arms with respect to the upper backing roll.

6. The roll stand defined in claim 5, wherein the bending cylinder acts upon the horizontal traverses that are guided at the balancing arms of the upper backing roll and on guide bars.

7. The roll stand defined in claim 1, wherein the bending arms are detachably connected to the horizontal traverses or to the balancing arms.

8. The roll stand defined in claim 1, wherein the work rolls are mounted in respective work-roll inserts, and the upper work-roll inserts are acted on vertically with a force via the bending arms.

9. The roll stand defined in claim 1, wherein the bending cylinder of the upper work roll is mounted on lower thickened regions of the bending arms.

10. The roll stand defined in claim 1, wherein the bending cylinder or balancing cylinder of the inserts of the lower work roll are mounted vertically in stationary blocks.

11. The roll stand defined in claim 1, wherein the bending cylinders of each bender include at least one cylinder braced between the balancing arm and the upper backing roll and at least one cylinder braced between the bending arm and the upper working roll.

* * * * *